United States Patent [19]

Wang

[11] Patent Number: 4,614,939

[45] Date of Patent: Sep. 30, 1986

[54] METHOD AND DEVICE FOR DETECTION OF A BLANKET OR THE LIKE BEING KICKED OFF THE BODY OF A SLEEPING PERSON

[76] Inventor: Chun-Jong Wang, No. 9, Lane 312, Min Sheng N. Rd., Tao Yan City, Taiwan

[21] Appl. No.: 598,029

[22] Filed: Apr. 9, 1984

[51] Int. Cl.[4] ..... G08B 21/00

[52] U.S. Cl. ..... 340/573; 340/540; 340/568

[58] Field of Search ..... 340/573, 568, 540, 600

[56] References Cited

U.S. PATENT DOCUMENTS 2,908,899 10/1959 Crafts ..... 340/568

4,411,034 10/1983 Williams ..... 340/568

*Primary Examiner*—Glen R. Swann, III

*Attorney, Agent, or Firm*—Asian Pacific International Patent and Trademark Office

[57] ABSTRACT

A blanket covers a light-sensing device that is attached to a portion of a sleeping person which is to be protected against cold. A weak light source is furnished. The light-sensing device is electrically connected with an alarm by means of an extension cable, if necessary. Upon the blanket being kicked off, the light-sensing device will be exposed to the weak light source to generate a signal which is passed to a current amplifier for amplification and activation of the alarm.

7 Claims, 7 Drawing Figures

30
BZ
17
14
R1
c
16
OPA
-
+
R
11
b
R3
19
18
32
VR
a
R2
31
15

METHOD AND DEVICE FOR DETECTION OF A BLANKET OR THE LIKE BEING KICKED OFF THE BODY OF A SLEEPING PERSON

BACKGROUND OF THE INVENTION

Because time for sleep in our life usually consumes about one third of our entire lifetime, proper rest is necessary. Proper rest is important, for example, when travelling long distances through different time zones. Only sufficient sleep can restore our mental and physical fatigues so as to efficiently carry out one's daily tasks.

It is a universal paradigm that parents of this world love and take care of their children. However, one of the most common headaches or problems in taking care of children is to properly cover them with a blanket or the like so that a sleeping child is adequately covered; and to prevent that the blanket is improperly removed, either in winter or summer time. When a sleeping child kicks off the blanket, the child is liable to catch cold, or is otherwise discomfortably affected. In order to prevent the children from being so affected, the parents can not help but get up periodically during the night and repeatedly check if the children's blanket have been kicked off or not. As a result, the parents are seldom allowed, during the growing period of their children, to have a full and relaxed sleep. This problem not only causes the parents considerable mental stress, but may also adversely affect their full work efficiency.

For adults catching cold as a result of kicking off the blanket during sleeping is also a common problem. In the final analysis, catching cold as a result of kicking off the blanket during sleeping is a general problem, and there has remained a need for determining if a blanket or the like has been kicked off by a baby, or a sleeping person.

SUMMARY OF THE INVENTION

This invention relates to a device for detection of a blanket or the like being kicked off the body of a sleeping person. The device comprises a light-sensing means, a photocell signal detector, a signal amplifier, and an alarm (a buzzer sound, or a music). The photocell signal detector of this device is to be attached before sleeping to the body which is to be protected from catching cold (such as the chest or stomach portion). Upon the blanket being kicked off during sleeping, the photocell signal detector will be exposed to a light to generate an alarm to warn the sleeping person himself (or herself), or the parents, so as to take the proper action by properly reinstating the blanket.

This invention may be used for babies, elders, in hospitals, etc. It is my belief that this invention is a new nurse device which costs less and needs no manpower, but can minimize the catching cold cases, and this is the major object of this invention.

SPECIFIC DESCRIPTION

Figure 2:
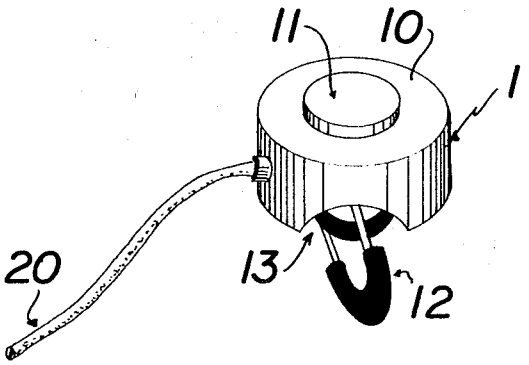
FIG. 2 is a perspective view of the light-sensing means in the present invention.

In the drawing like reference characters designate like elements in the various views of the drawings.

This invention relates to a device for detecting whether or not a blanket or the like is disposed in the normal or proper condition. More particularly, the device comprises a detector in the form of a photocell adapted to generate a signal in conformity with a predetermined amount of light to which the photocell is exposed, a signal amplifier, and an alarm. This device will generate an alarm signal upon a blanket or the like being improperly positioned on, or fully kicked off from, the sleeper's body, or from a vital part of the sleeper.

Figure 1:
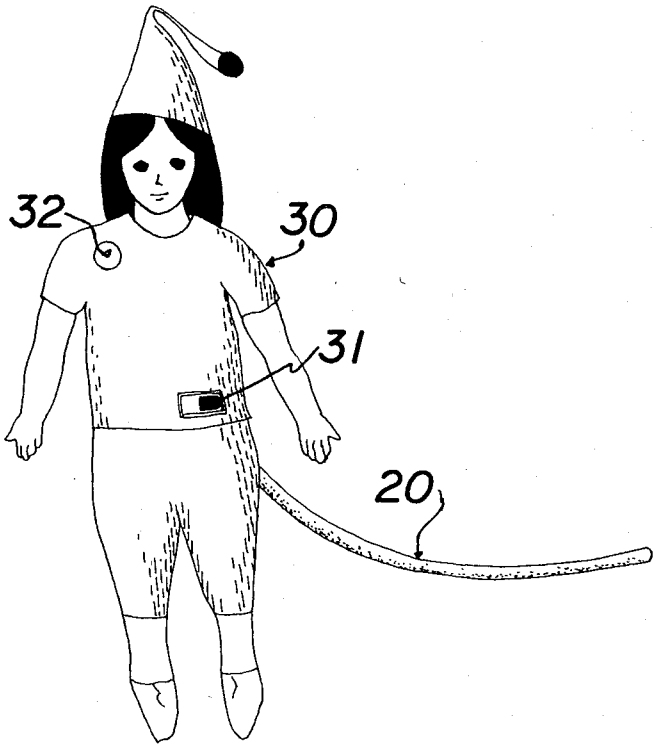
FIG. 1 is a perspective view of the alarm of the present invention.
Figure 3:
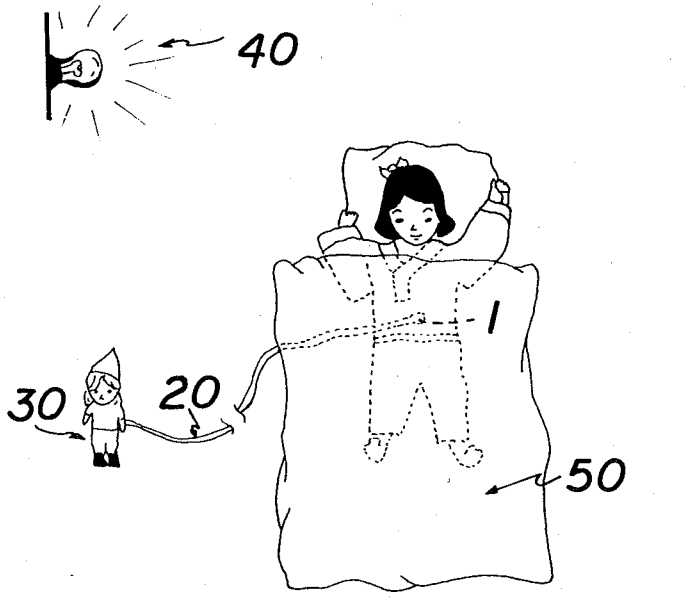
FIG. 3 shows the alarm of the present invention in the normal or inactive state.

Referring to FIG. 1, there is shown an outer view of the alarm device of the present invention, generally designated by reference numeral 30. The light-sensing means is generally identified by reference numeral 1 (FIG. 2). The light-sensing means 1 is a portable or movable device that has a safety pin 12 adapted to be attached in a small hole 13 under a base 10. By means of the safety pin 12, the light-sensing means 1 may be attached to a portion of a sleeper's clothing, particularly at a body portion that should be covered by a blanket, generally designated by reference numeral 50, compare FIGS. 3 and 4. For utilization of this invention on a sleeper's body, a visible, but generally weak light, for example a light bulb of 40 watts strength, designated by reference numeral 40, or a source of infrared radiation or rays, can be used. In the normal condition, as is shown in FIG. 3, the light-sensing means 1 is not exposed to light because it is covered by the blanket 50, and the alarm 30 will not be activated. As soon as the blanket 50 is kicked off by the sleeper, as suggested in FIG. 4, the light-sensing means 1 is exposed to the respective light and the photocell signal detector 11, also referred to as photocell hereinafter, of the light-sensing means 1 generates an output signal which will be transmitted via the extension cable 20 to the alarm 30. The alarm 30 will generate an audible signal, for example, a musical tune, or other sound, to warm someone who takes care of the sleeper, or the sleeper per se can reposition the blanket 50.

Referring to FIG. 2, in the base 10 of the light-sensing means 1 is provided the small hole 13 which is used for attaching the safety pin 12. A signal can be generated by the photocell 11, and this is transmitted via the extension cable 20 to the alarm 30 (FIG. 1). Of course, when the light-sensing means 1 is covered by the blanket 50, as is indicated in FIG. 3, a signal will not be generated by the photocell 11. However, when the blanket has been kicked off, the photocell 11 is exposed to the light of bulb 40, or other sufficiently strong light source, as shown in FIG. 4, and a signal will be generated immediately.

Figure 4:
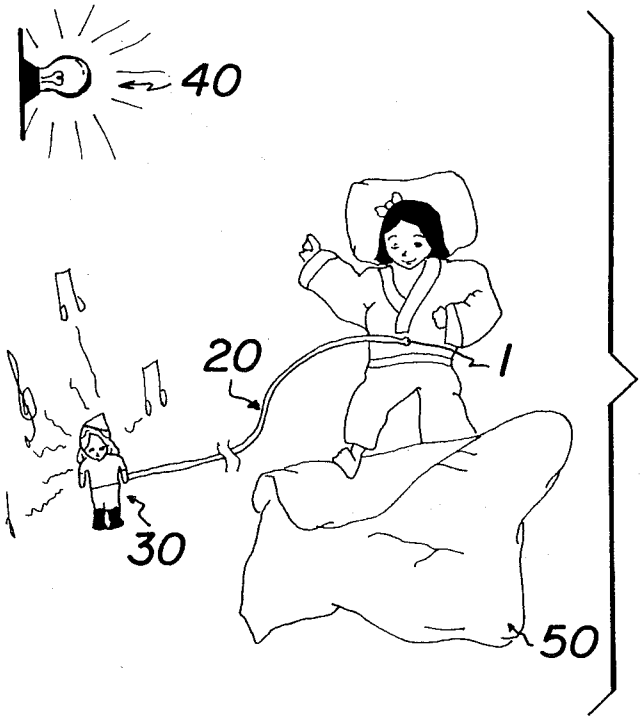
FIG. 4 shows the alarm of the present invention in the active state.

Referring to FIGS. 3 and 4, there is shown the alarm 30 in the normal or inactive state and in the operative state, respectively. The alarm 30 may be installed inside a doll or a toy for decoration purposes. The extension cable 20 is used for installing the alarm 30 in a remote place, such as another room, in order to increase the operational scope of the alarm.

Figure 5:
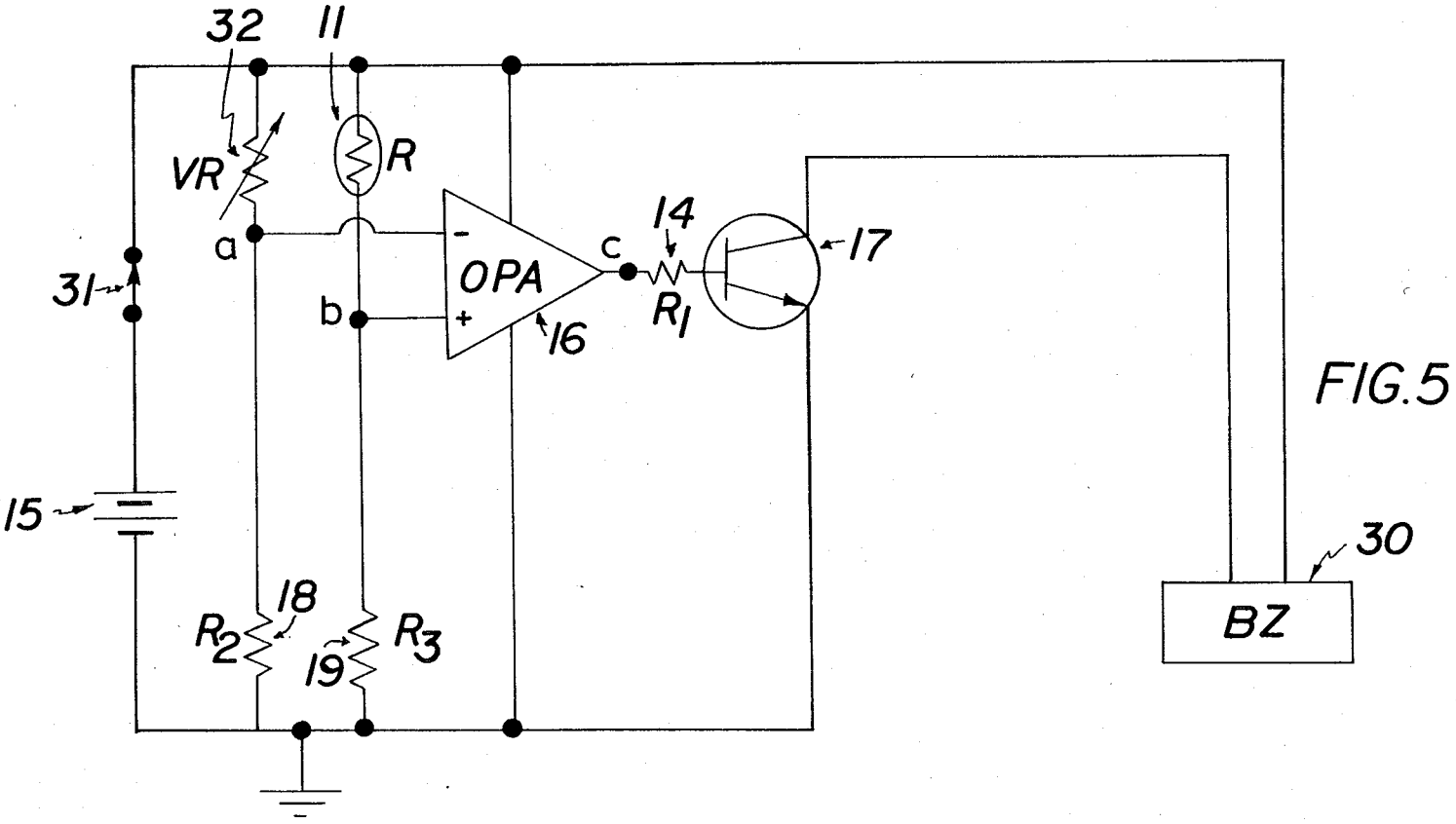
FIG. 5 is the circuit diagram of the present invention.

Referring to FIG. 5, there is shown a circuit diagram of the present invention. Included in this is an operational amplifier 16, a resistor R2, identified by reference numeral 18, and a resistor R3, identified by reference numeral 19. The circuit further includes the photocell 11, a variable resistor VR, designated by reference numeral 32, etc. to form a bridge and balance circuit. The output points of the balance voltage are set on "a" and "b". The condition of the balance is to be determined in accordance with the equation:

$$VR \times R3 = R \times R2$$

wherein VR is used for adjusting the balance.

Under balance state, there is no voltage across the points "a" and "b". Since the points "a" and "b" are also the input terminals of the operational amplifier 16, the amplifier 16 has also no input voltage; likewise, the output terminal "c" of the operational amplifier 16 has no output. Naturally, the alarm 30 is then not activated. However, whenever the photocell 11 is exposed to light, say that of bulb 40, the resistance of the photocell 11 will be reduced, while the current thereof will be increased. Simultaneously, the voltage (according to Ohm's Law: V = IR) across the photocell 11 will also be increased. In that case, the voltage on point "b" is higher than that of point "a", i.e., $Vab = Vb - Va$; simultaneously, the operational amplifier 16 will have an input voltage Vab, and will have an output at point "c". Since the output current of the operational amplifier 16 is rather weak, it should be amplified by way of transistor 17 and resistor R1, designated by reference numeral 14, so as to activate or power the alarm 30 for warning purposes. A power supply switch 31 is used for controlling the battery 15.

Figure 6:
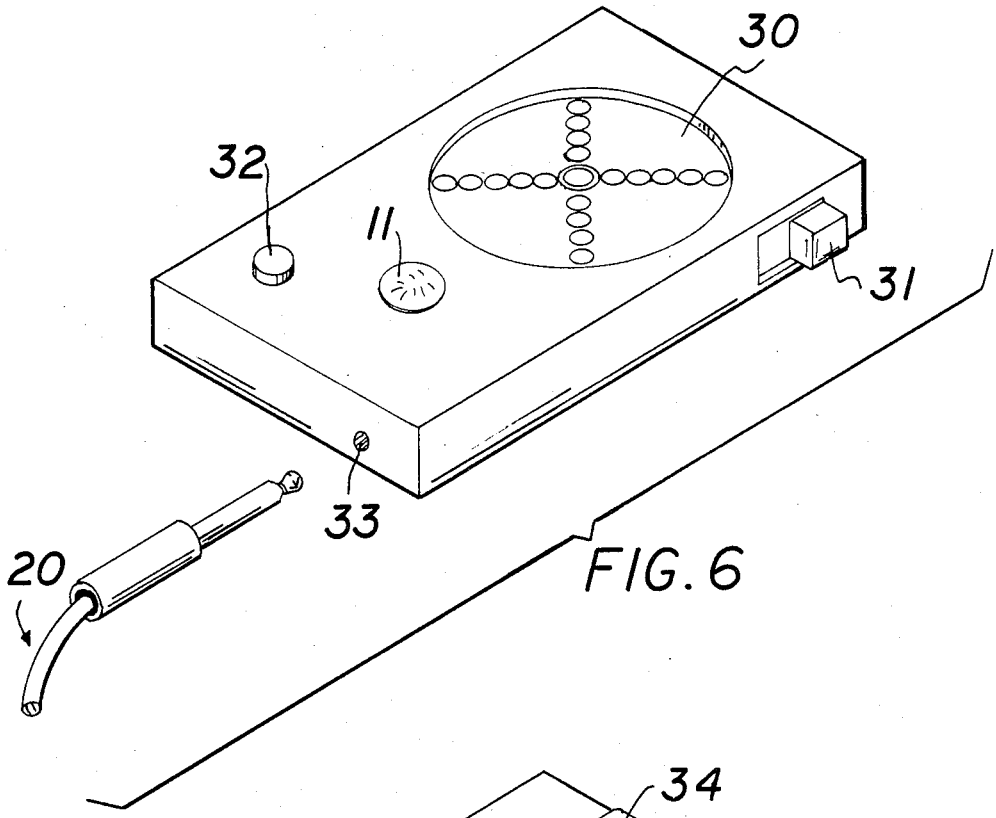
FIG. 6 is a perspective view of a combination detector and alarm in accordance with another embodiment of the present invention

Referring to FIG. 6, there is shown a combination photocell 11 and alarm 30. The alarm 30 may be made in the form of a small music box, in which a small battery may be used. The alarm 30 may also be connected to an external signal detector for increasing the functions of the alarm, i.e. the alarm can be directly attached to the user's body, or in the place where it is in the vicinity of the user's mother.

Figure 7:
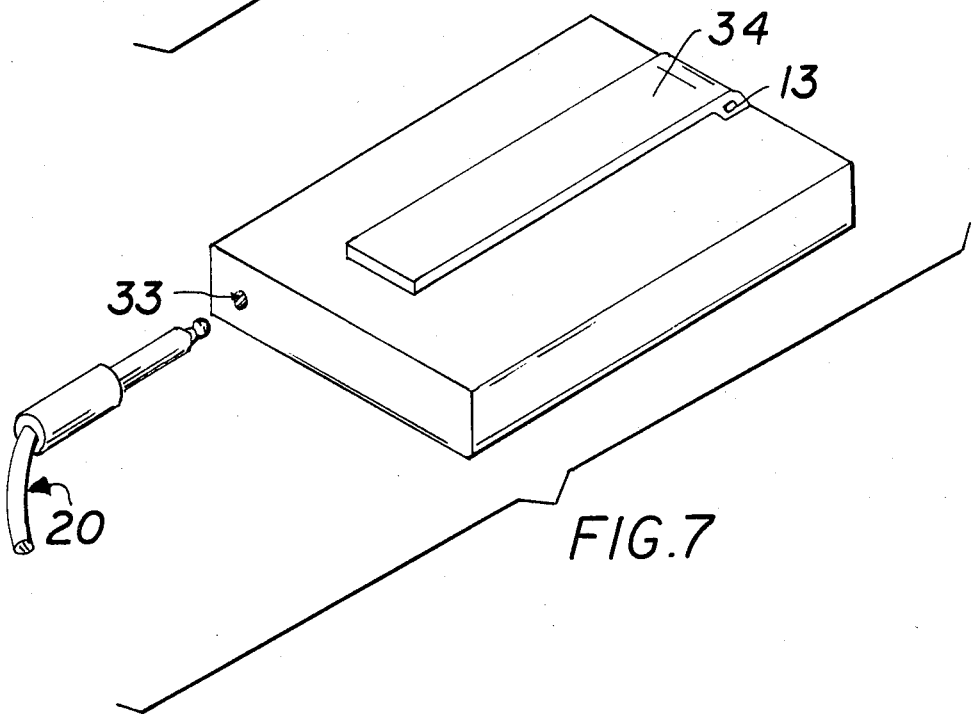
FIG. 7 is a rear view of the combination in FIG. 6.

Referring to FIG. 7, there is shown the rear view of the combination light-sensing means 1 and alarm 30, in which a clamping piece 34 is provided on the back of the alarm 30, and on the clamping piece a small hole 13 is furnished so as to allow attaching of the alarm 30 directly to an important part of a user, with a safety pin or by sewing thereto.

Reference in this disclosure to details of the specific embodiments is not intended to restrict the scope of the appended claims, which themselves recite those features regarded as essential to the invention.

I claim:

1. A device for detection of a blanket or the like being improperly positioned on a sleeping person, said device comprising in combination:

a light-sensing means for generating an output signal in response to a light source and including at least a light-responsive photocell;

a signal amplifier operatively connected to said light-sensing means for receiving and amplifying said output signal; and an alarm connected to said amplifier for producing a warning signal in response to the amplified output signal.

2. The device according to claim 1, wherein said light-sensing means includes a base having an upper portion and a lower portion, wherein said upper portion is furnished with said photocell, and wherein said lower portion is furnished with means for fastening purposes.

3. The device according to claim 1, wherein said light-sensing means is to be attached to the clothes over a user's chest portion, and is covered with a blanket or the like; whereby since the photocell is not exposed to light, the alarm generates no sound; and whereby in response to the blanket's being kicked off, said photocell will be exposed to light, and the alarm will produce an audible warning signal.

4. The device according to claim 1, wherein said warning signal is a musical signal.

5. The device according to claim 1, wherein said alarm is installed in a doll.

6. The device according to claim 1, wherein said alarm and said photocell are housed in a common housing.

7. The device according to claim 1, wherein said photocell is responsive to visible light and invisible light.

* * * * *